US010717014B2

(12) United States Patent
Ozturk

(10) Patent No.: US 10,717,014 B2
(45) Date of Patent: Jul. 21, 2020

(54) BOWL-TYPE WATERSLIDE ASSEMBLY

(71) Applicant: POLIN SU PARKLARI VE HAVUZ SISTEMLERI ANONIM ŞIRKETI, Kocaeli (TR)

(72) Inventor: Ali Sinan Ozturk, Kocaeli (TR)

(73) Assignee: POLIN SU PARKLARI VE HAVUZ SISTEMLERI ANONIM SIRKETI, Kocaeli (TR)

( * ) Notice: Subject to any disclaimer, the term of this patent is extended or adjusted under 35 U.S.C. 154(b) by 0 days.

(21) Appl. No.: 16/308,822

(22) PCT Filed: Jul. 11, 2016

(86) PCT No.: PCT/TR2016/050221
§ 371 (c)(1),
(2) Date: Dec. 11, 2018

(87) PCT Pub. No.: WO2018/013062
PCT Pub. Date: Jan. 18, 2018

(65) Prior Publication Data

US 2019/0247759 A1 Aug. 15, 2019

(51) Int. Cl.
*A63G 21/18* (2006.01)

(52) U.S. Cl.
CPC ..... *A63G 21/18* (2013.01)

(58) Field of Classification Search
CPC ..... A63G 21/18
USPC ..... 472/117
See application file for complete search history.

(56) References Cited

U.S. PATENT DOCUMENTS

| | | | | |
|---|---|---|---|---|
| 891,388 | A | 6/1908 | Visser et al. | |
| 5,011,134 | A * | 4/1991 | Langford | A63G 21/18 104/70 |
| 6,062,983 | A * | 5/2000 | Butsook | A63G 21/18 4/488 |
| 6,354,955 | B1 | 3/2002 | Stuart et al. | |
| 6,485,372 | B2 * | 11/2002 | Stuart | A63G 21/18 472/117 |
| D567,322 | S | 4/2008 | Hunter | |
| 2002/0077187 | A1 | 6/2002 | Stuart et al. | |
| 2007/0093305 | A1 * | 4/2007 | Lauren | A63G 4/00 472/128 |

(Continued)

FOREIGN PATENT DOCUMENTS

| | | | |
|---|---|---|---|
| CN | 203123552 | U | 8/2013 |
| DE | 202009014520 | U1 | 3/2011 |

(Continued)

*Primary Examiner* — Michael D Dennis
(74) *Attorney, Agent, or Firm* — Bayramoglu Law Offices LLC

(57) ABSTRACT

A bowl-type waterslide assembly includes a sliding lane, an inlet having a first radial form and allowing a rider to access the bowl-type waterslide assembly, an outlet having a greater slope than the inlet and having a second radial form, a path allowing the rider to slide, and having a curved form and configured to provide a non-stop travel between the inlet and the outlet, a wall element in an omega form is configured for partitioning the path into a plurality of separate sections. A water distribution part is configured to provide water to the bowl-type waterslide assembly, the water distribution part is provided above the omega form of the wall element and extends through the wall element in a groove form.

3 Claims, 2 Drawing Sheets

(56) References Cited

U.S. PATENT DOCUMENTS

| | | | | |
|---|---|---|---|---|
| 2009/0239671 | A1* | 9/2009 | Brassard | A63G 21/10<br>472/117 |
| 2012/0100921 | A1* | 4/2012 | Brown | A63G 21/18<br>472/117 |
| 2014/0213379 | A1* | 7/2014 | Svendsen | A63G 21/18<br>472/117 |

FOREIGN PATENT DOCUMENTS

| | | | |
|---|---|---|---|
| WO | 2011115593 | A1 | 9/2011 |
| WO | 2015161382 | A1 | 10/2015 |

* cited by examiner

BOWL-TYPE WATERSLIDE ASSEMBLY

CROSS REFERENCE TO RELATED APPLICATIONS

This application is the national phase entry of International Application No. PCT/TR2016/050221, filed on Jul. 11, 2016, the entire contents of which are incorporated herein by reference.

TECHNICAL FIELD

The present invention relates to a bowl-type waterslide having one or more sliding lane guiding rider from an entry of the bowl to the end.

BACKGROUND

Typical waterslide design technology utilizes a bowl structure as an element of the waterslide assembly. Such waterslides usually cause a rider's entry into the bowl with a tangential trajectory by means of a flume and travel around a helical path inside the bowl before leaving a hole below the bowl.

The rider cannot track a fixed path due to the lack of any guides with the commonly used bowl-type waterslides. Inconsistent performance leads the rider to slide a couple of to and from movement at a sliding surface. Capacity of the waterslide is delimited to the maximum elapsed time for the rider's travel. The change of the rider's travel time decreases user capacity of the waterslide. Such a design is anticipated by the United States patent document US2002077187.

Another application from prior art disclosed by United States design patent document numbered U.S. Pat. No. 5,673,225 shows a bowl type waterslide comprising an inlet and an outlet which are in the radial form and a path having curved form and elongating between the inlet and outlet to allow a user to slide continuously throughout the path.

Another application from prior art disclosed by United States patent document US 2009/0239671 wherein a waterslide bowl has a fixed rider path from entrance to exit and made of a plurality of sets of trough sections allowing homogeneous sliding experience. The waterslide is similar to the bowl-type from a top view and it is seen from side view that formed by a number of flumes spirally mounted to each other. There is an elevation difference between each one of the outer set and the inner set.

Bowl-type waterslides commonly utilized does not contain a lane. This lead rider's elapsed time of travel inside o waterslide is different from each other and decrease user capacity of the waterslide. Lack of water effect requires rider's own effort to reach the exit. This may cause safety losses. Additionally, due to the lack of lanes only one rider can use the waterslide at a time. Competition and race features of the products which are relevant for amusement are removed by only one rider's presence at one bowl. A straight path from entry to exit provides a better user experience and provides homogeneous travel time.

Obtaining a bowl-type effect by providing a spiral connection between multiple flume require high number of molds to be used for production and increases total cost of the product. Elevation difference between spiral steps are present in the waterslides having a bowl-type effect due to the lack of a bowl and such a solution result the feeling of riding a normal waterslide.

SUMMARY

Starting from the prior art, an object of the present invention is providing a bowl-type waterslide having a fixed user path from entry to exit of the waterslide.

Another object of the invention is providing a waterslide having walls mountable to the surface of the bowl and partitioning lanes therein.

Another object of the invention is providing a bowl type waterslide at which user capacity is increased by means of following the fixed user path without any changes required on the bowl surface.

Another object of the invention is providing walls suitable for waterslide form and partitioning the lanes without any require to change the molds.

Another object of the invention is obtaining a bowl-type waterslide consisting of walls which increases sliding effect of the rider inside the waterslide and providing a fluid to the sliding system.

Another object of the invention is allowing multiple riders to slide at the same time and increase competitive feeling inside the lanes of a bowl-type waterslide.

Another object of the invention is providing a bowl-type waterslide where the riders use vehicles like boats, mats or the like. Such vehicles are able to slide at the same time in the same waterslide.

Another object of the invention is providing a bowl-type waterslide having lanes obtained by a few moulds.

Another object of the invention is providing a bowl-type waterslide where the baffle effect of the water is increased to prevent rider to guiding movements.

BRIEF DESCRIPTION OF THE DRAWINGS

In order to achieve the above-mentioned objectives, a bowl-type waterslide assembly is shown with the illustrative figures.

In the drawings.

Figure 1:
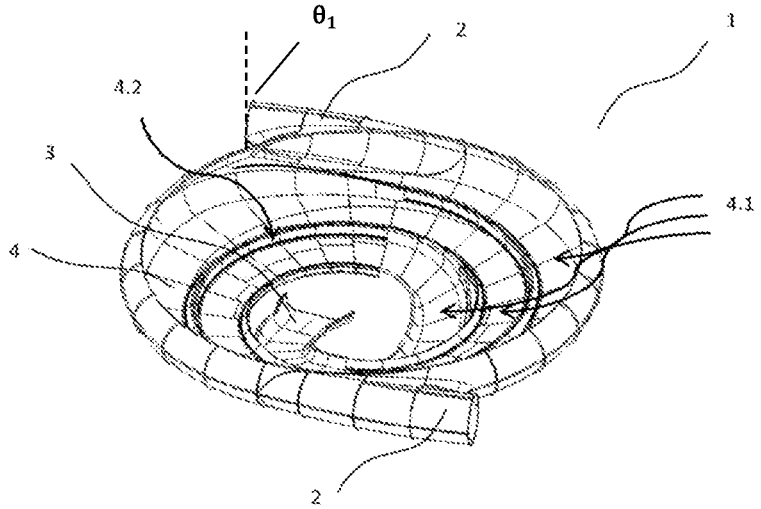
FIG. 1 is a perspective view of a bowl-type waterslide assembly of an embodiment of the present invention.
Figure 2:
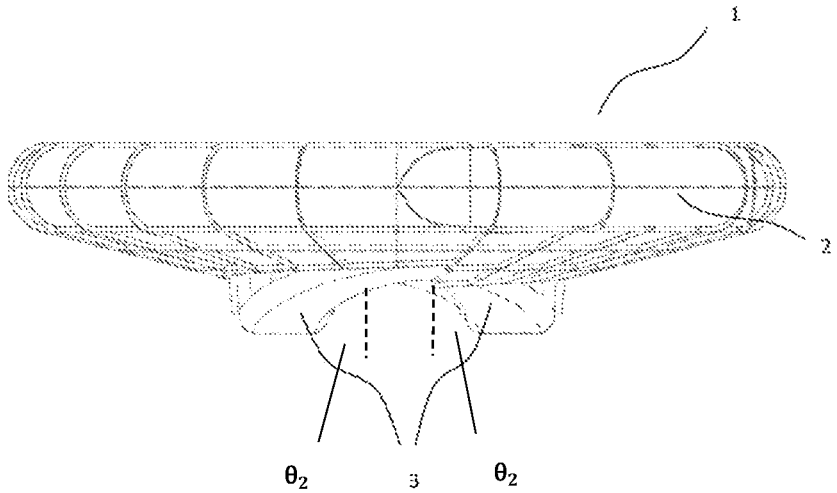
FIG. 2 is a side view of a bowl-type waterslide assembly of an embodiment of the present invention.
Figure 3:
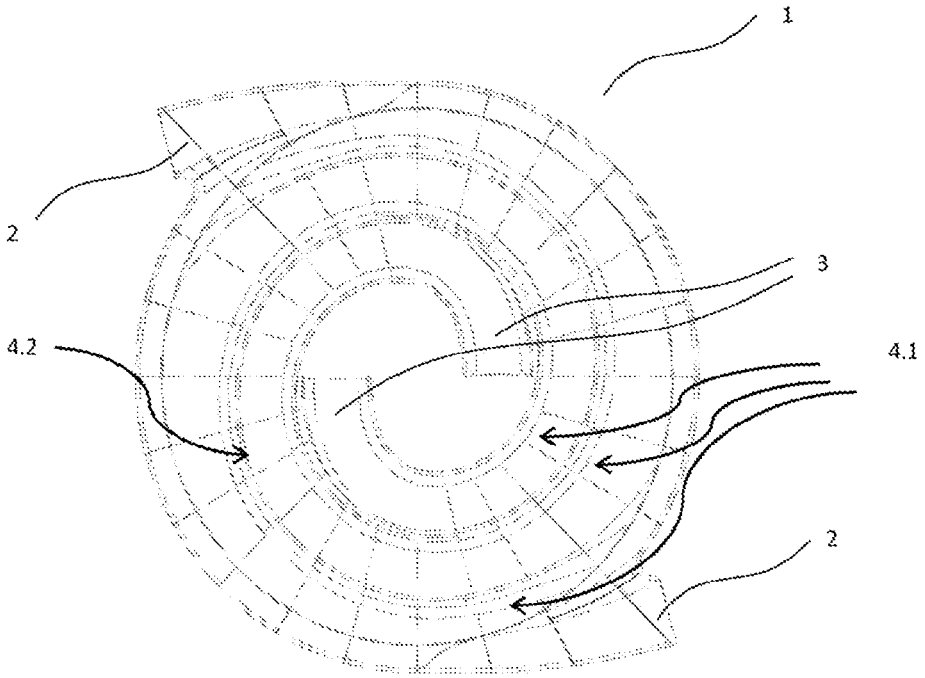
FIG. 3 is a top view of a bowl-type waterslide assembly of an embodiment of the present invention.
Figure 4:
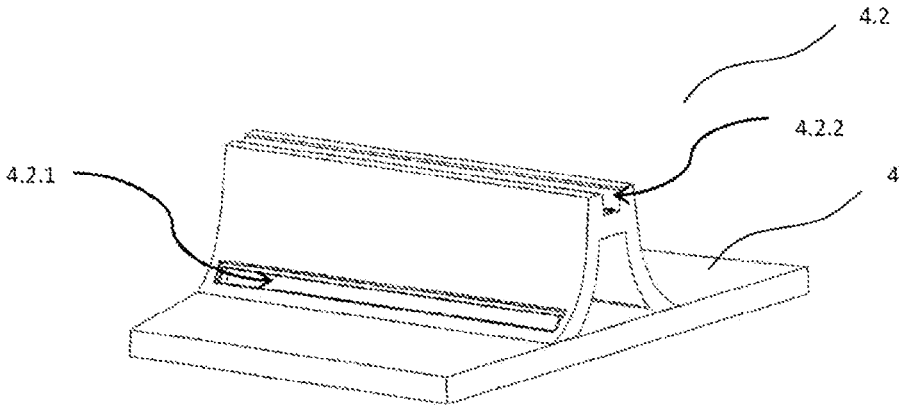
FIG. 4 is a perspective view of the wall element.

1. Bowl-type waterslide assembly
2. Inlet
3. Outlet
4. Path
  4.1. Lane
  4.2. Wall element
    4.2.1. Mounting part
    4.2.2. Water distribution part
    $\theta_1$ Slope of the inlet
    $\theta_2$ Slope of the outlet

DETAILED DESCRIPTION OF THE EMBODIMENTS

Subject matter of the invention is a bowl-type waterslide assembly (1), basically including:

an inlet (2) allowing rider to the access to bowl-type waterslide assembly (1) and having a radial form, an outlet (3) at a greater slope than the inlet (2) and having a radial form, and a path (4) allowing multiple riders to slide, having a curved form and configured to provide non-stop travel between the inlet (2) and the outlet (3).

As shown in FIG. 1, in a bowl-type waterslide assembly (1), a rider enters to the inlet (2) at a predetermined speed, and moves towards the path (4) having a lane (4.1) allowing homogenous and continuous traveling experience until reaching the outlet (3). Rider may use riding means, such as a cushion, mat, boat and tube or may travel at the bowl-type waterslide assembly (1) without any means.

Rider's speed at the inlet (2) increases when moving towards the outlet (3) having greater slope $\theta_2$ comparing to the inlet (2) slope $\theta_1$.

According to a subject matter of a bowl-type waterslide assembly (1), the path (4) between the inlet (2) and the outlet (3) having greater slope comparing to the inlet (2) has a continuous and similar curved structure.

The path (4) with curved form consists of lanes (4.1) allowing a multiple rider to homogeneously and continuously slide. The lane (4.1) is formed by a wall element (4.2) partitioning the path (4) into the separate sections. Each one of the sections defines a lane (4.1) individually.

The lanes (4.1) are configured to provide sliding movement for more than one rider at the same path (4). This create competition environment for the riders.

The lane (4.1) has a guiding configuration at the bowl-type waterslide assembly (1). Each one of the rider's effect on sliding movement is delimited so that safe and homogeneous travel time is ensured from the inlet (2) to the outlet (3).

The wall element (4.2) has an omega formed shape suitable for the form of the mounting part (4.2.1) and the curved form of the path (4), thus being mounted to the path (4) without leaving any gap or roughness.

The forming of the wall element (4.2) allows riders to enjoy homogeneous and continuous riding experience at the lanes (4.1). Mounting part (4.2.1) is extending at the both sides below the omega form.

Water required for the ride is provided to the bowl-type waterslide assembly (1) by means of the water distribution part (4.2.2) provided at the top of the omega form and in the shape of a groove and extending towards the wall element (4.2). Water allows removal of the holes towards the outlet and allows rider to move on a smooth surface.

In a preferred embodiment, the wall element (4.2) is a part made of a glass fiber reinforced composite material. The wall elements (4.2) can be mounted to the path (4) or each other by means of any suitable mounting means (e.g. fastening means, polymerisation welding, glue, etc.).

The type of the omega form which is the form of the wall element (4.2) can vary based on the bowl-type waterslide assembly (1) to be used. In this way, inventive bowl-type waterslide assembly (1) can be obtained by using a few molds without any need to modify existing molds for waterslide production.

What is claimed is:

1. A bowl waterslide assembly, comprising:

a sliding lane, an inlet having a first radial form and allowing a rider to access the bowl waterslide assembly, an outlet having a greater slope than the inlet and having a second radial form, a path allowing the rider to slide, and having a curved form and configured to provide a non-stop travel between the inlet and the outlet, a wall element partitioning the path into a plurality of lanes; and wherein, the wall element comprises a water distribution part in form of a groove, wherein the groove is provided between the plurality of lanes and formed on an upper surface of the wall element and extending into the wall element, and a mounting part, wherein the mounting part extends below both sides of the water distribution part.

2. The bowl waterslide assembly according to claim 1, wherein the plurality of lanes are configured to allow guiding from the inlet to the outlet for a plurality of riders.

3. The bowl waterslide assembly according to claim 1, wherein the wall element is made of a glass fiber reinforced composite material.

* * * * *